US005182536A

United States Patent [19]

Boylan et al.

[11] Patent Number: 5,182,536

[45] Date of Patent: Jan. 26, 1993

[54] SURFACE MOUNT CURRENT TRANSFORMER STRUCTURE

[75] Inventors: Jeffrey J. Boylan, Dallas; Lennart D. Pitzele, Rockwall, both of Tex.

[73] Assignee: AT&T Bell Laboratories, Murray Hill, N.J.

[21] Appl. No.: 907,088

[22] Filed: Jul. 1, 1992

[51] Int. Cl.[5] ..... H01F 27/30

[52] U.S. Cl. ..... 336/65; 336/192; 336/198; 336/223

[58] Field of Search ..... 336/65, 192, 198, 208, 336/223, 225, 61; 310/194

[56] References Cited

U.S. PATENT DOCUMENTS

| | | | |
|---|---|---|---|
| 4,510,478 | 4/1985 | Finkbeiner | 336/198 |
| 4,835,841 | 6/1989 | Gunnels et al. | 336/198 |
| 4,939,494 | 7/1990 | Masuda et al. | 336/192 |

*Primary Examiner*—Thomas J. Kozma
*Attorney, Agent, or Firm*—C. E. Graves

[57] ABSTRACT

A miniature current transformer is equipped with a primary winding insert formed as a stamped metal piece with elongate legs and a flange portion disposed at 90 degrees to the legs. The top of the flange is unobstructed by other structural details, and is wide enough to be gripped by vacuum pick-and-place equipment. At the same time the insert is electrically functional as the transformer's primary winding. The flange rests on surfaces formed in the transformer bobbin. The insert legs are mounted through passages n the bobbin leading out to the bobbin's bottom side. The legs are formed into gull-wing ends that have a dual role as lock tabs to secure the insert on the bobbin, and as the primary leads.

10 Claims, 3 Drawing Sheets

SURFACE MOUNT CURRENT TRANSFORMER STRUCTURE

FIELD OF THE INVENTION

This invention relates to transformers for power conversion applications and particularly to lightweight inexpensive current transformers used on printed circuit boards and the like.

BACKGROUND OF THE INVENTION

Typically, a miniature current transformer consists of a bobbin for mounting the primary and secondary windings, the windings themselves, and standard core inserts. Frequently, the primary winding has many fewer turns than the secondary winding and must handle substantially more current. The primary usually is made of a heavier gage wire.

This construction typically results in a bobbin with an irregular, as opposed to a substantially flat, winding surface. A large proportion of the assembly equipment which automates the manufacture of printed circuit board ("PCB") assemblies rely on vacuum picked heads to acquire and place the PCB components. However, the vacuum heads do not function well in picking up irregular surfaces.

In the prior art, adapting miniature transformer structures to vacuum pickup has involved adding flat, electrically non-functional pickup surfaces to the transformer structure. These additions, however, have increased the material costs and have complicated the soldering steps.

SUMMARY OF THE INVENTION

The invention essentially is a new form of miniature current transformer which uses a novel primary winding insert. The insert advantageously is made as a stamped metal piece with elongate legs and a flange portion. A flat top formed in the flange is shaped to be wide enough for ready vacuum gripping while at the same time is shaped to be functionally acceptable as a primary winding.

The primary winding insert is formed with a 90-degree fold that fits over the top of the bobbin to provide a smooth, flat and centered pickup surface. The top surfaces of the supporting bobbin are co-planar with the pickup surface, or alternatively may be somewhat recessed. The insert legs are mounted through passages in the bobbin which lead out from the interior to the opposite side of the bobbin. The legs formed into gull-wing ends that serve as a lock tab and as primary leads.

DETAILED DESCRIPTION OF AN ILLUSTRATIVE EMBODIMENT

Figure 1:
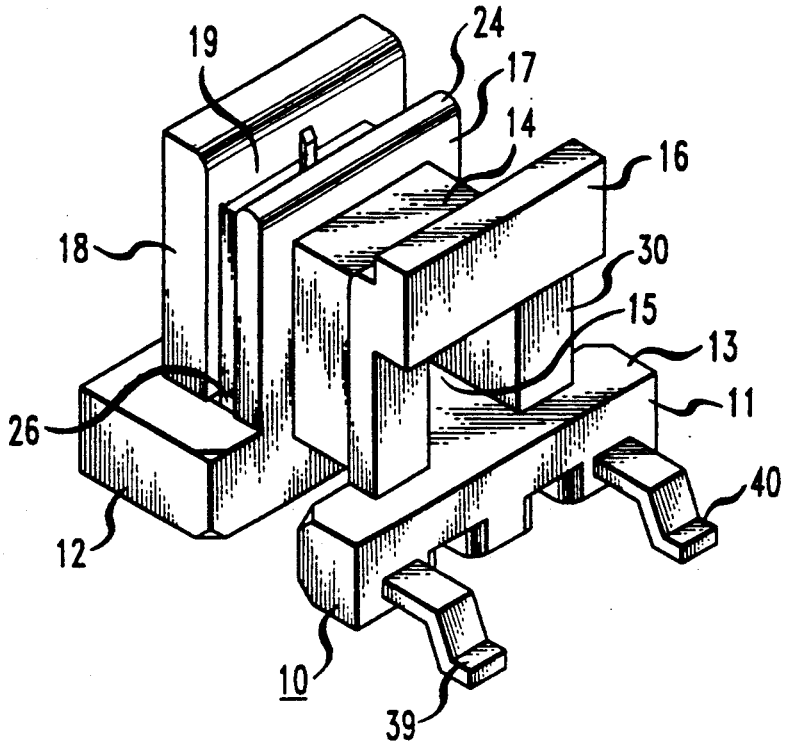
FIG. 1 is a front perspective view of a bobbin assembly.

As seen in FIG. 1, a bobbin 10 consists of a left footing 11 and a right footing 12. The top surface of the two footings 11, 12 comprise a planar platform 13. A secondary winding armature 14 with a hollow center 15 that extends through the entire bobbin, is formed between and end 16 rising from footing 11, an internal wall 17 and a second end 18 which also rises from footing 12.

Figure 2:
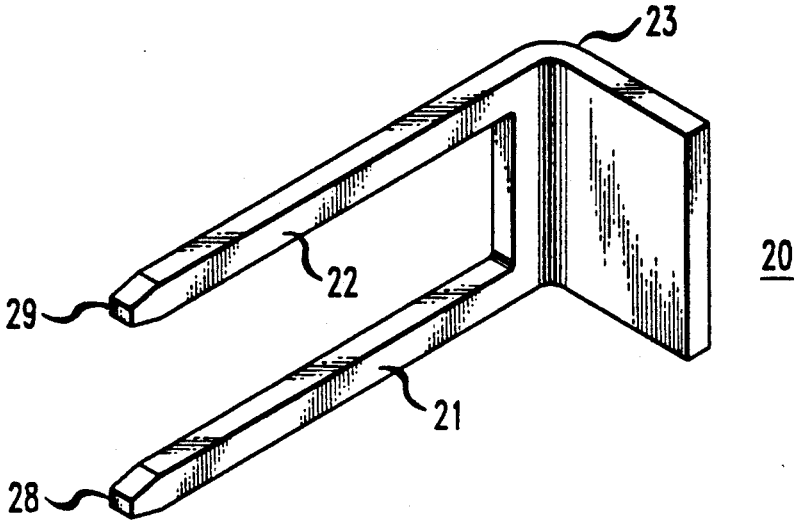
FIG. 2 is a front perspective view of the insert piece part.
Figure 6:
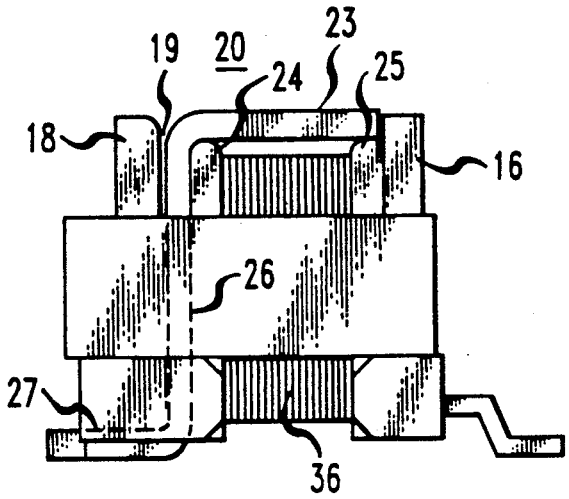
FIG. 6 is a side view of the invention as fully assembled.

In accordance with the invention, insert 20 is provided with two legs 21, 22 as seen in FIG. 2. A well 19 seen in FIGS. 1 and 6 created by the space between end 18 and wall 17 accommodates the two legs 21, 22 of the insert 20. The top flange 23 of the insert 20 is formed with a 90 degree bend as seen in FIG. 6. One end of the underside of the flange 23 rest on the rounded top end portion 24 of the wall 17. The far end of the flange 23 rest on a rounded shoulder 25 formed on the interior side of the end 16 of bobbin 10.

As seen in FIG. 6, the legs 21, 22 mount through slots 26 formed through the platform 13 at the base of the well 19. The slots join with recessed portions 27 formed in the bottom of footing 12, allowing the legs 21, 22 to be bent to form the insert into a Z-shape which fixes the insert onto bobbin 10. The end portions of the legs 21, 22 are formed with a slight taper as seen in FIG. 2, to become the primary winding solder terminations 28, 29.

Figure 5:
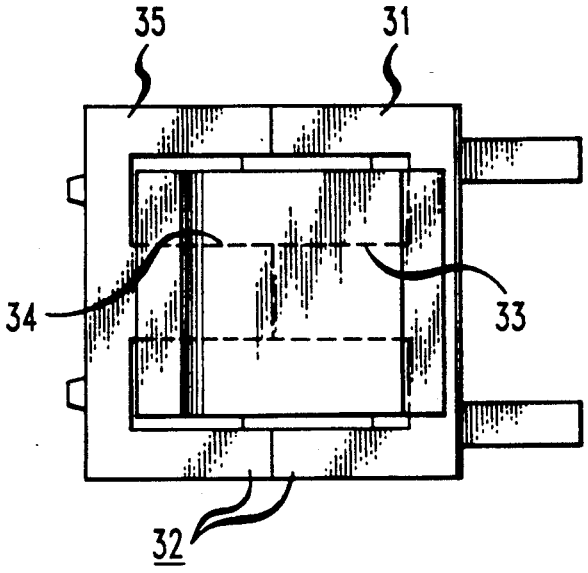
FIG. 5 is a top view of the invention showing the core elements in place.

As seen in FIGS. 1 and 5, an inset portion 30 formed in the exterior wall of end 16 provides a mount for a first half 31 of a transformer core 32. The center leg 33 of core half 31 fits into the hollow 15 of end 16 which is seen in FIG. 1. The center leg 34 of core left half 35 fits into a corresponding hollow formed through the end 18 and the wall 19.

Figure 3:
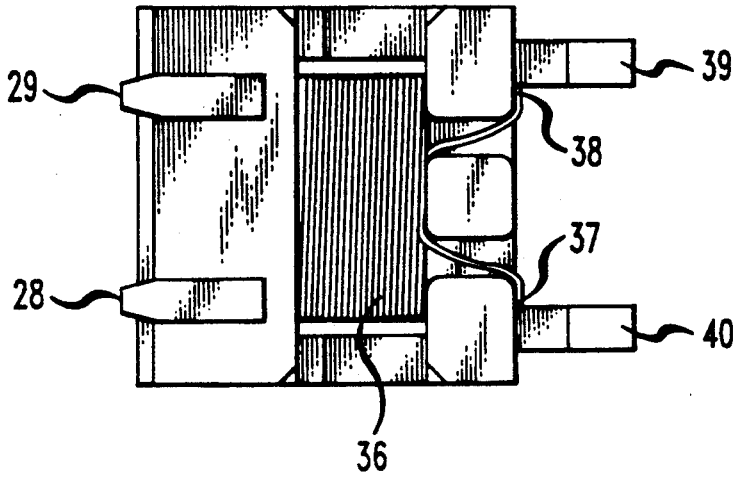
FIG. 3 is bottom view of the bobbin assembly with the secondary winding and the insert installed.
Figure 4:
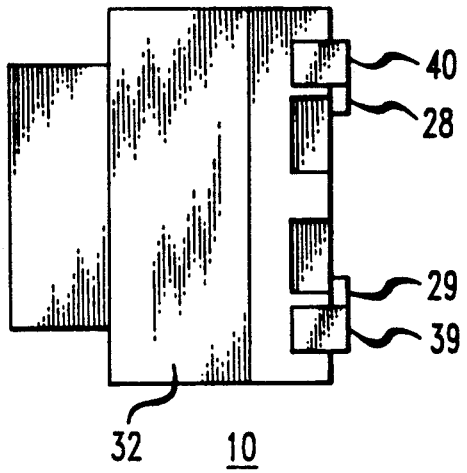
FIG. 4 is a side view of the bobbin assembly.

The armature 14 shown in FIG. 1 is wound with a secondary winding 36 shown in FIG. 3, with the winding ends 37, 38 being connected to the secondary winding terminals 39, 40 molded or post-inserted after molding into the footing 11. The ends of the terminals 39, 40 may be offset to form feet as shown in FIG. 1.

The top flange 23 of the insert fits into the space provided between the tops of the shoulder 25 and end 24, and the tops of the ends 16, 18 as illustrated in FIG. 6. In this installed position, the flange 23 clears the secondary windings 36 and at the same time protrudes only a slight amount beyond the tops of the ends 16, 18. The top of the flange 23 is flat and readily available as a pickup surface for a vacuum chuck of a component positioner employed during the automated assembling of the transformer.

The four leads 28, 29, 39, 40 are used to center the bobbin on a vacuum nozzle (not shown) for accurate placement.

The new transformer structure thus permits the use of vacuum pick and place equipment without the addition of any electrically non-functional pick-up surfaces. The flange of the primary insert of the invention provides a smooth pick-up surface over the irregular surface commonly presented by the primary and secondary winding configurations of similar transformers of the prior art. The primary winding of the present invention is also electrically functional and carries current in addition to providing the flat pick-up surface. The ability to pick up the component by its flange, and further to use the four terminals for centering, results in improved registration of the transformer assembly.

We claim:

1. A power conversion transformer comprising:

a bobbin having a base platform, first and second end walls extending from said base platform, an interior wall formed adjacent to said first end wall to form a well, and a secondary winding armature disposed between said interior wall and said second end wall;

a secondary wire winding wrapped on said armature; and an insert element constituting the primary winding of said transformer comprising:

two elongate legs disposed in said well and a flange bent at substantially right angles to said legs, the flange having a flat top surface exterior to said right angle to serve as a pick-up surface for vacuum pick-and-place equipment; and the underside of said flange being disposed in close proximity to a section of said secondary winding, and being supported on the top edge of said interior well.

2. A transformer in accordance with claim 1, wherein said bobbin further comprises:

first and second slots formed through said platform on opposite sides of said bobbin at the base of said well, for passing said insert legs through;

recessed portions formed in the bottom of said bobbin; and the end portions of said legs being bent into said recesses and extending away from said bobbin thereby to fix insert element onto said bobbin.

3. A transformer in accordance with claim 2, wherein the end portions of said legs are each formed with a slight taper to comprise solder terminations for said primary winding.

4. A transformer in accordance with claim 3, wherein said armature further comprises a center passage extending through said bobbin.

5. A transformer in accordance with claim 4, further comprising:

a rounded shoulder formed on the interior side of said second end wall; and the far end of said flange resting on said rounded shoulder.

6. A transformer in accordance with claim 5, further comprising:

first and second E-shaped transformer core segments each having a center leg and two end legs;

said core segment center legs being mounted into opposite ends of said bobbin center passage; and said end legs wrapping around opposite exterior sides of said bobbin.

7. A transformer in accordance with claim 6, wherein the exterior side of said second end of said bobbin includes and inset portion formed on the exterior side for mounting said second core segment.

8. A transformer in accordance with claim 7, wherein the top surfaces of said bobbin end walls are substantially co-planar with said pick-up surface.

9. A transformer in accordance with claim 7, wherein the top surfaces of said bobbin end walls are recessed with respect to said pick-up surface.

10. A transformer in accordance with claims 1, 2, 3, 4, 5, 6, 7, 8, or 9, further comprising a printed circuit boarding mounting said transformer.

* * * * *